United States Patent [19]

Richter et al.

[11] Patent Number: 4,486,896

[45] Date of Patent: Dec. 4, 1984

[54] X-RAY GENERATOR INCORPORATING AUTOMATIC CORRECTION OF A DOSE-DETERMINING EXPOSURE PARAMETER

[75] Inventors: Detlev Richter; Thomas Bürrig, both of Hamburg, Fed. Rep. of Germany

[73] Assignee: U.S. Philips Corporation, New York, N.Y.

[21] Appl. No.: 406,602

[22] Filed: Aug. 9, 1982

[30] Foreign Application Priority Data

Aug. 13, 1981 [DE] Fed. Rep. of Germany ..... 3132057

[51] Int. Cl.[3] ..... H05G 1/30

[52] U.S. Cl. ..... 378/108; 378/110; 378/112

[58] Field of Search ..... 378/108, 97, 110, 112

[56] References Cited

U.S. PATENT DOCUMENTS 4,121,104 10/1978 Richter ..... 378/108

*Primary Examiner*—Craig E. Church

*Attorney, Agent, or Firm*—Jack E. Haken

[57] ABSTRACT

The density of an X-ray exposure depends not only on the exposure parameters, but also on the film development parameters. In order to eliminate the effect of fluctuations in the latter parameters, the X-ray generator in accordance with the invention comprises a measuring device which measures the density of a test exposure and which acts on an adjusting member for the exposure parameters. By subjecting the test exposure to the same conditions as the X-ray exposure, the effects of parameter fluctuations during film processing process can be eliminated to a high degree.

7 Claims, 1 Drawing Figure

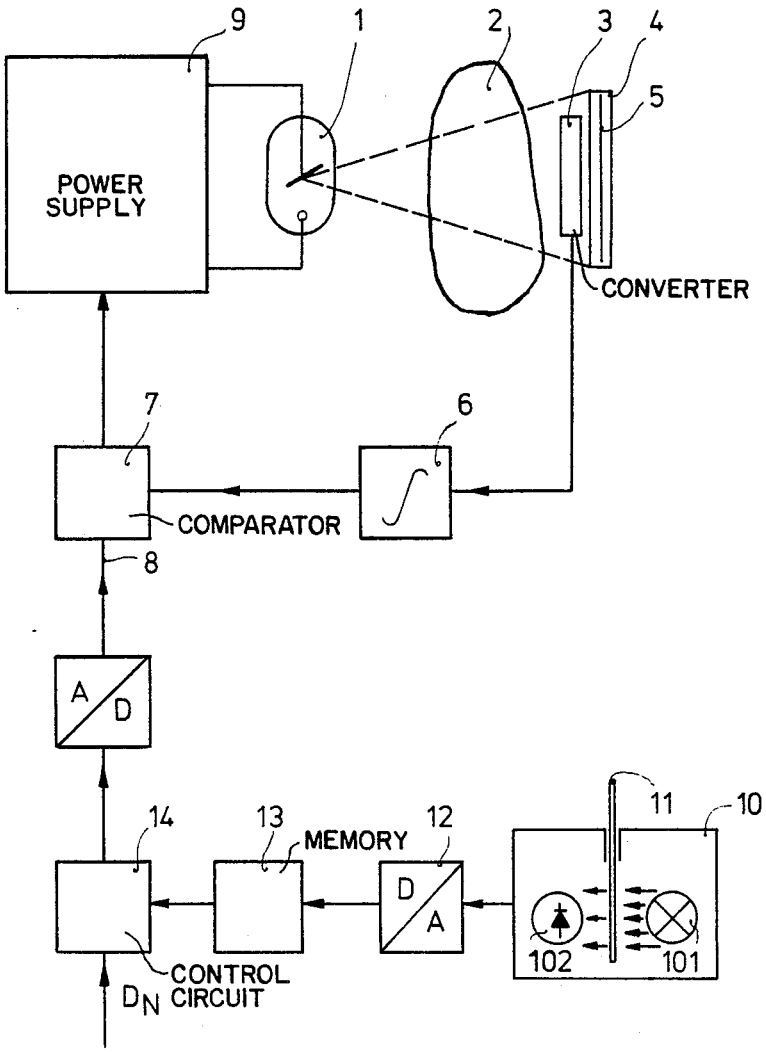
9
1
2
3
4
5
POWER SUPPLY
CONVERTER
7
6
COMPARATOR
8
A
D
14
13
MEMORY
12
11
10
D
A
102
101
CONTROL CIRCUIT
$D_N$

X-RAY GENERATOR INCORPORATING AUTOMATIC CORRECTION OF A DOSE-DETERMINING EXPOSURE PARAMETER

BACKGROUND OF THE INVENTION

The invention relates to an X-ray generator comprising a correction device which provides automatic correction of at least one dose-determining exposure parameter in dependence of the deviation of a measurement value from a predetermined value and which acts on an adjusting member for the exposure parameters.

An X-ray generator of this kind is known from German patent document No. 19 44 481. In the known X-ray generator, the dose power is measured during the exposure and the switch-off dose (and also the voltage applied to the X-ray tube) at which the radiation is switched off by an automatic exposure device is changed in dependence of the deviation of the measurement value from a predetermined value. The sets of exposure parameters preset for different human organs can thus be automatically adapted to the absorption or the thickness of the patient.

Tests have demonstrated that, when taken over a prolonged period of time (a few days), the quality of radiographs is not reproducible. For example, when a correct exposure of a patient is repeated with the same exposure parameters, an incorrect exposure could be obtained in given circumstances. This effect is caused by fluctuations in the image recording system which is formed by film, foil and film-processing. Such fluctuations could occur in the chemical composition of the various baths required for film processing, but could also be temperature fluctuations of, for example, the development bath, fluctuations of the level of the baths, or fluctuations of the processing time. When viewed over a shorter period of time, i.e. one working day, these fluctuations are comparatively small, so that their effect is not yet disturbing; however, from one working day to another the parameters may fluctuate to such an extent that incorrect exposures occur. Moreover, there are fluctuations in the film sensitivity, for example, when a fresh film package is opened or when a film of a different manufacturer is used. Generally, such fluctuations are noticed only after a number of incorrect exposures and they cannot be satisfactorily compensated for according to the present state of the art.

SUMMARY OF THE INVENTION

It is an object of the present invention to provide an X-ray generator which can cope with such parameter fluctuations occurring during X-ray exposures and which can automatically at least approximately eliminate the consequences thereof. Using an X-ray generator of the kind set forth, this object is achieved in that there is provided a density measuring device for measuring the density of a test exposure of an object having a defined absorption, said device supplying a signal which is dependent on the density and which is combined with a predetermined value of the exposure parameter in a control circuit for controlling at least one exposure parameter of said X-ray generator.

The invention is based on the idea that a test exposure, i.e. an exposure (which may also be a radiographic exposure) of a body having a defined absorption with defined exposure parameters (tube volage, mAs-product) or of a sensitometer strip, is subject to the consequences of said parameter fluctuations in the same way as the X-ray exposure of an arbitrary object with freely selectable exposure parameters if the test exposure and the X-ray exposure are performed with films from the same film batch. These fluctuations become apparent as fluctuations of the density of the test exposure which is converted into an electric signal by the density measuring device, said signal changing, via the control circuit, an exposure parameter (preferably the mAs-product in the case of two-knob or three-knob control or the switch-off dose when an automatic exposure device is used) so that the effect of said fluctuations on the exposures is reduced, if not completely eliminated. When a test exposure is made at regular intervals (at the beginning of a working day usually suffices), followed by development in the relevant development system and introduction into the density measuring device, the correction thus obtained for the exposure parameters remains valid for the subsequent exposures.

A preferred embodiment in accordance with the invention comprises a memory in which the value of the output signal of the density measuring device is stored. Thus, continuous measurement of the test film by means of the density measuring device is no longer necessary, because the value determined by the density measuring device is stored in the memory.

THE DRAWING

The invention will be described in detail hereinafter with reference to the drawing.

The drawing shows an X-ray source 1 which irradiates an object 2, after which the radiation attenuated by the object 2 passes through a converter 3 and is incident on a film cassette which contains a film sheet 5 for recording the radiation image behind the object 2.

The converter 3, for example, an ionization chamber, produces an electric signal which is dependent on the dose power and which is applied to an integrator 6 whose output signal is a measure for the dose behind the object and hence also for the mean density produced on the film sheet 5. If the converter 3 is constructed so that its electric output signal corresponds directly to the dose, of course, the integrator 6 may be omitted. The electric output signal of the integrator 6 which corresponds to the dose behind the object 2 is applied to an input of a comparator circuit 7, the other input 8 of which carries a signal which corresponds to the switch-off dose.

The X-ray source 1 is powered by a power supply unit 9 which comprises a high-voltage supply as well as the adjusting members required for the adjustment of the exposure parameters and switching members for switching the X-rays on and off. The power supply unit 9 is controlled by the comparator circuit 7 so that the X-rays are switched off as soon as the signal on the output of the integrator 6 which corresponds to the dose reaches the value of the signal on the input 8 which corresponds to the switch-off dose. The X-ray generator described thus far is known from the above-referenced German document.

The value of the signal on the input 8 which corresponds to the switch-off dose depends on the one hand on the choice made by the operator and on the other hand on a correction value which is determined so that the effect of parameter fluctuations of the development system in which the film sheet 5 is processed after the exposure is eliminated to a high degree. To this end there is provided a density measuring device 10 in which a test exposure 11 can be introduced, i.e. a film sheet which has been taken from the same batch as the film sheet 5 and which represents an exposure of a test object which has a defined absorption, for example, an aluminium scale, and which has been made with predetermined exposure parameters. The test exposure is passed through the same development system as that whereto the film sheet 5 is applied after the exposure. The test exposure may be a radiograph of the test object in which case the tube voltage and the mAs-product must be preset, or an exposure made by means of visible light.

The density measuring device 10 comprises a light source 101 which is arranged so that the test exposure is irradiated at the area of a predetermined density step of the density scale, recorded by means of the aluminium scale, preferably the test exposure is irradiated at an area of homogeneous density. The light which is weakened by the test exposure is measured and is converted into an electric signal by means of a suitable detector, for example, a photodiode 102. The electric signal is a measurement for the density or the transparency of the test exposure.

The electric signal supplied by the density measuring device 10 is converted into a digital signal in an analog-to-digital converter 12, said digital signal being stored in a memory 13. The content of the memory 13 is combined in a control circuit 14 with a signal which corresponds to the standard switch-off dose $D_N$ (which is the switch off dose for the case where the density of the test exposure or the various parameters during the film development correspond to the standard) so that the switch-off dose on the input 8 is increased when the density of the test exposure is below a predetermined standard value and that the switch-off dose is reduced when the density exceeds the standard value. The digital signal $D_N$ can be derived in known manner from the memory (not shown) of an X-ray generator which can be programmed by the operator.

When the output signal of the density measuring device depends linearly on the transparency which is known to be proportional to the logarithm of the density, the control circuit 14 may be constructed as a combinational logic circuit or as an adder circuit (in that case the output signal of the density measuring device should have the value zero in the case of standard density or standard transparency of the test exposure). However, it is in principle also possible to construct the circuit 14 so that it supplies an output signal which depends on the product of its input parameters (the output signal of the density measuring device should then deviate from zero (e.g. should be unity) in the case of standard density or standard transparency). Of course other exposure parameters (mA, sec.) can be controlled if desired, instead of the switch-off dose signal $D_N$, which has been described hereinbefore by the way of example.

What is claimed is:

1. An X-ray generator for powering and controlling an X-ray tube for radiography, comprising:

means which supply power to the tube during a radiographic exposure;

means which measure the value of the radiation dose which is delivered to a radiographic medium during the exposure and which produce a signal indicative thereof;

means which compare the value of the radiation dose indicating signal with the value of a predetermined signal and which control one or more parameters of the power supplied to the tube in response to any deviation of the dose indicating signal from the predetermined signal;

means which measure the density of an image of a known test object which has been produced on a sample of the radiographic medium and which provide a signal indicative thereof; and means which adjust the value of the predetermined signal in response to the value of the measured density signal in order to correct the exposure for variations in the effective sensitivity of the medium.

2. The generator of claim 1 where the radiographic medium is photographic film.

3. The generator of claim 1 or claim 2 wherein the means which control parameters of the power supply comprise an automatic exposure control which switches off power to the tube when the dose reaches a predetermined switch-off value and wherein the means which adjust the value of the predetermined signal adjust the switch-off value in response to the density indicating signal.

4. The generator of claim 1 or claim 2 wherein the means which control the parameters of the power supply include a two-knob control or a three-knob control which controls the value of the mAs-product delivered to the tube and wherein the means which adjust the value of the predetermined signal control the value of a desired mAs-product in response to the value of the measured density signal.

5. The generator of claim 1 or 2 further comprising a memory which stores the value of the measured density signal and wherein the means which adjust the value of the predetermined signal do so in response to the value of the signal stored in said memory.

6. The generator of claim 5 wherein the means which control parameters of the power supply comprise an automatic exposure control which switches off power to the tube when the dose reaches a predetermined switch-off value and wherein the means which adjust the value of the predetermined signal adjust the switch-off value in response to the density indicating signal.

7. The generator of claim 5 wherein the means which control the parameters of the power supply include a two-knob control or a three-knob control which controls the value of the mAs-product delivered to the tube and wherein the means which adjust the value of the predetermined signal control the value of a desired mAs-product in response to the value of the measured density signal.

* * * * *